US006663082B1

(12) United States Patent
Ploeger

(10) Patent No.: US 6,663,082 B1
(45) Date of Patent: Dec. 16, 2003

(54) FASTENER REMOVAL TOOL

(75) Inventor: Randall J. Ploeger, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 10/191,312

(22) Filed: Jul. 9, 2002

(51) Int. Cl.[7] ..... B66F 3/00
(52) U.S. Cl. ..... 254/21; 254/129
(58) Field of Search ..... 254/129, 21, 25, 254/131, 18; 29/267, 295

(56) References Cited

U.S. PATENT DOCUMENTS

| | | | | | |
|---|---|---|---|---|---|
| 584,189 | A | * | 6/1897 | Nelson | 254/25 |
| 838,987 | A | * | 12/1906 | Hanking | 254/25 |
| 3,029,502 | A | * | 4/1962 | Middaugh | 254/129 |
| 3,744,758 | A | * | 7/1973 | Nakasone | 254/129 |
| 3,825,226 | A | * | 7/1974 | Appleman | 254/28 |
| 4,205,823 | A | * | 6/1980 | Goldy | 254/28 |
| D256,442 | S | * | 8/1980 | Martin | D10/77 |
| 5,031,881 | A | * | 7/1991 | Thurmston | 254/28 |
| 5,870,811 | A | * | 2/1999 | Ciok | 254/28 |
| D414,095 | S | | 9/1999 | Hoepfl et al. | |
| 5,964,009 | A | | 10/1999 | Hoepfl et al. | |
| 6,409,152 | B1 | * | 6/2002 | Bagley | 254/28 |
| 6,471,186 | B1 | * | 10/2002 | Lawless | 254/25 |

OTHER PUBLICATIONS

General Tools Manufacturing Co. Inc.: Part #801 —Brad & Tack Puller.

Snap–On Tools: Part #ASG 185 —Trim Pad, Soft Grip, Tool.

Steck Manufcturing: Part #21510 —10–In–One Trim Tool.

Lisle Corporation: Part #35400 —Door Upholstery Remover.

* cited by examiner

*Primary Examiner*—Robert C. Watson
(74) *Attorney, Agent, or Firm*—Banner & Witcoff, Ltd.

(57) ABSTRACT

A fastener removal tool includes a handle, a projecting axial rod with a wedge shaped end for engaging the flange of a fastener and a slidable fulcrum member positioned on the rod.

10 Claims, 2 Drawing Sheets

FIG.3
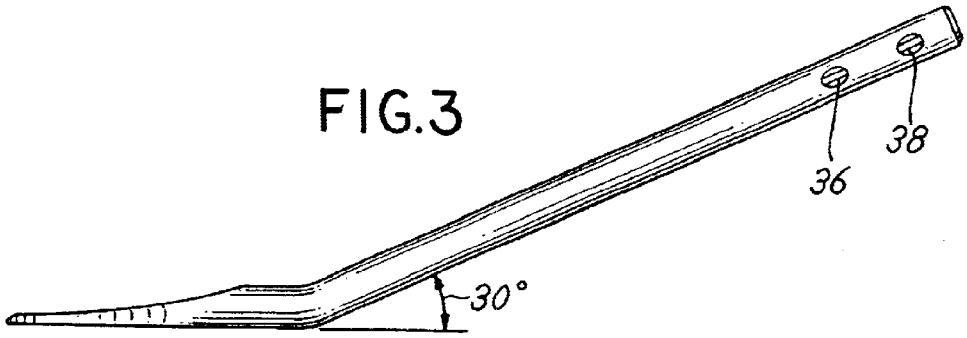
FIG.4
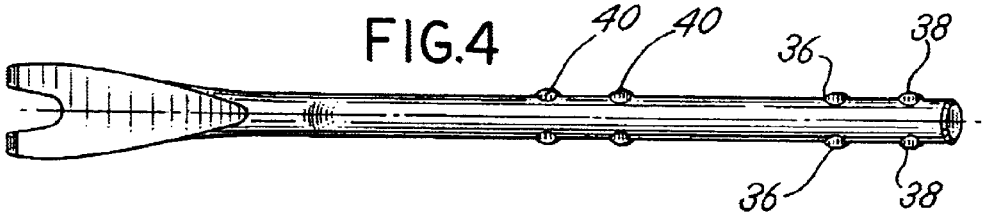
FIG.5
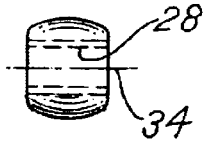
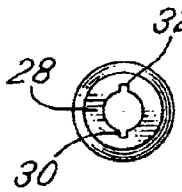
FIG.6
FIG.7
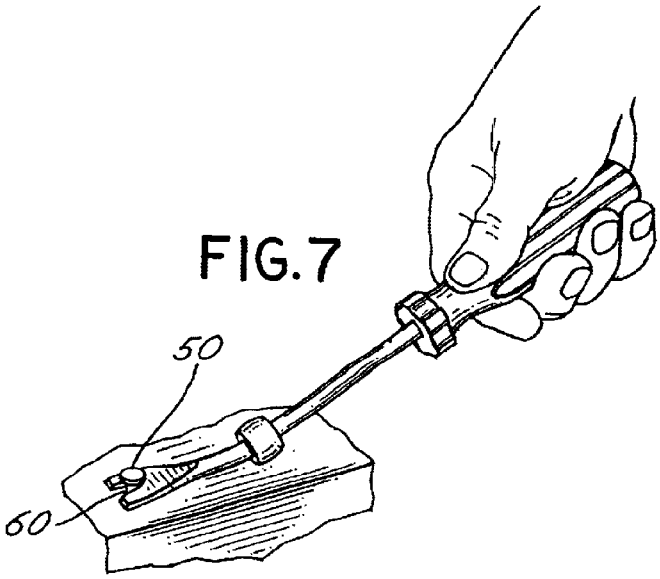

FASTENER REMOVAL TOOL

BACKGROUND OF THE INVENTION

In a principal aspect, the present invention relates to a tool for removal of fasteners of the type having a head with a projecting stud for attachment of the fastener into a substrate.

Various types of plastic fasteners that hold weather stripping, radiator shrouds, fender linings, air dams and other plastic or rubber parts often need to be removed in order to effect removal of the part associated with repair of a vehicle or machinery. Tools for such removal typically comprise items that have the appearance of a screwdriver with a bifurcated forward foot or end which is wedged under the fastener and then pivoted in order to remove the fastener. Thus, the tip of the tool is engaged under the fastener and the tool is then maneuvered in a manner which disengages the fastener from the item or part which constitutes the substrate to which the shroud, weather stripping, etc. might be attached.

A problem that may occur with respect to such an arrangement relates to the movement that must be effected by the tool in order to remove the fastener. That is, often the tool is positioned in such a manner that it is difficult to effectively pivot or move the tool. The bifurcated foot or wedge thus cannot properly be engaged with the fastener to remove it from the substrate. The present invention addresses circumstances of this nature.

SUMMARY OF THE INVENTION

Briefly, the present invention comprises a tool for removal of fasteners of the type having an exposed head defining a flange and further having a projecting stud from the head that effects attachment of the fastener to a substrate. The fastener thus may fit through a liner, weather stripping, or the like and hold such material or item onto the substrate. The tool includes a handle with a longitudinal rod member that projects axially from the handle. The rod member includes a working end for engagement under the flange of the fastener in a manner which enables the operator to pry the fastener from a substrate. The rod further includes an axial segment having a substantially uniform cross section. Finally, the tool includes a fulcrum member in the form of an annular elastomeric button which is slidably mounted on the axial segment of the rod and which is longitudinally slidable or adjustable on the rod to define a fulcrum for the working or active end of the tool. The fulcrum member is adjustable to thereby enable improved mechanical advantage or a change in the pivoting action in the operation of the tool. Additionally, the fulcrum member may be moved along the axial rod to a position where it does not, or cannot, be utilized to provide a fulcrum for the tool. Thus, in a situation where large fasteners, such as plastic fasteners, require a large amount of travel in order to remove them, appropriate positioning of the fulcrum member enables the operator to provide a larger movement upon pivoting of the tool. Additionally, in circumstances where the plastic fasteners are located in inaccessible areas because of the structural shape of the component parts involved, adjustment of the fulcrum member or ring will enable improved mechanical advantage and positioning of the working end of the tool. Further, the ring or fulcrum member is made from an elastomeric type material which will avoid scratching or scarring various surfaces against which the member is positioned. When the ring is not needed, then it can be slid along the shaft or rod into an inactive position.

Thus, it is an object of the invention to provide an improved fastener removal tool, especially a tool which may be utilized to remove plastic fasteners.

Another object of the invention is to provide a fastener removal tool which is easy to operate, adjustable, rugged, inexpensive, and useful in many different situations.

These and other objects, advantages and features of the invention will be set forth in the detailed description which follows.

BRIEF DESCRIPTION OF THE DRAWING

In the detailed description which follows, reference will be made to the drawings comprised of the following figures:

FIG. 3 is a side elevation of the axial rod and working end of the tool of the invention;

FIG. 4 is a top plan view of the rod and working end of FIG. 3;

FIG. 5 is a side elevation of the fulcrum member of the tool of the invention;

FIG. 6 is an end view of the fulcrum member of FIG. 5; and

FIG. 7 is an isometric view of the method of use of the tool.

DETAILED DESCRIPTION OF THE INVENTION

Figure 1:
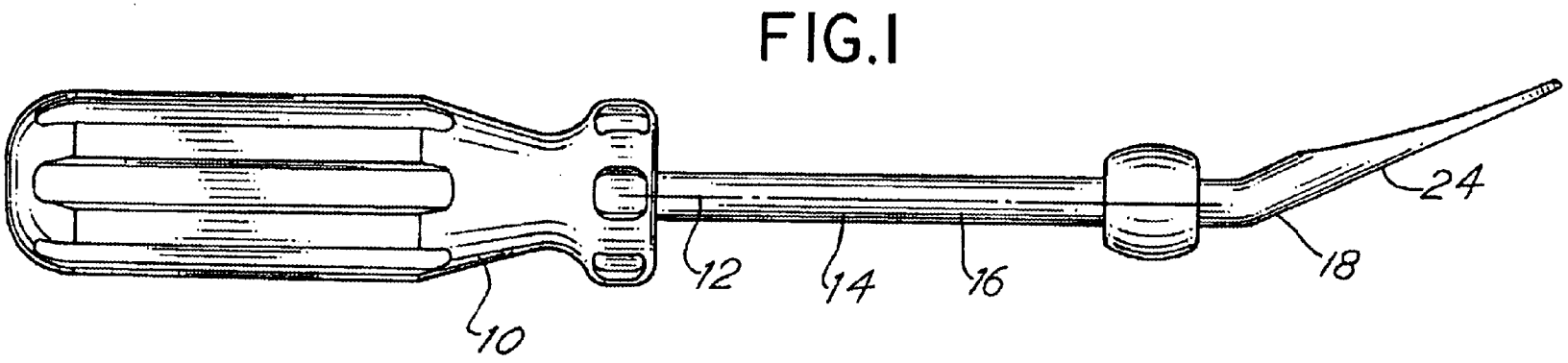
FIG. 1 is a side elevation of the tool of the invention.
Figure 2:
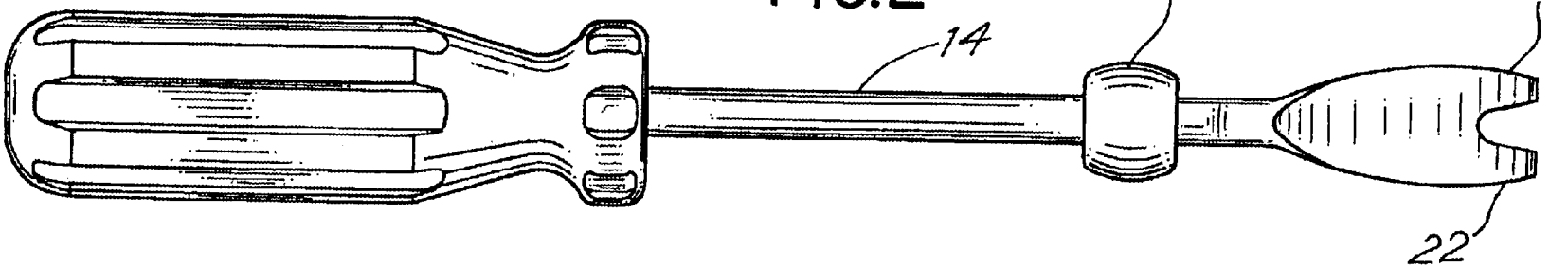
FIG. 2 is a top plan view of the tool of FIG. 1.

Referring to the figures, the tool is comprised of a handle 10 having a longitudinal axis 12 and an axial rod or member 14 projecting axially from the handle 10. The handle 10 may be manufactured from a molded plastic material, for example. The rod member 14 is comprised of a circular cross section, longitudinally extending axial rod section 16 and a distal working end 18. The distal working end 18 is formed in the shape of first and second projecting spaced prong 20 and 22 at the end of a wedge shaped section 24. The distal end 18 extends from the axis 12 of rod section 16 at an angle of approximately 30°.

Slidably mounted on the rod 14 is an annular, fulcrum member 26. In the embodiment depicted, the annular fulcrum member 26 includes a center passage 28 as well as first and second opposite axial, internal slots 30 and 32 on opposite sides of an axis 34 of the annular member in passage 26. The slots 30 and 32 are designed to permit the member 26 to slide over the retention prongs 36 and 38 formed in the end of the rod 14. The prongs 36 and 38 facilitate maintenance of the handle 10 on the rod 14 during the manufacturing operation. Thus, with respect to manufacture of the tool, the rod 14 is initially formed. The fulcrum member is then placed on the rod by sliding over the prongs 36 and 38. Then the handle 10 is pressed onto the rod 14.

The fulcrum member 26 is preferably made from an elastomeric material such as urethane. The internal annular passage 28 in the fulcrum member 26 is sized to permit the member 26 to slide axially on the rod 14. With appropriate sizing, the fulcrum member 26 will remain in a selected slide position due to frictional engagement with rod 14. Alternatively, detent projections, such as a detent projection 40, may be provided on the outer surface of rod 14 to facilitate maintenance of the fulcrum member 26 in a desired position.

The working end of the rod 14 has a wedge shape to facilitate insertion of the working end under the flange 50 of a fastener 60. The working end of rod 14 has a cross sectional configuration which prevents removal of fulcrum member 26. As shown in FIG. 7, the working end may be inserted under the flange 50 of the fastener 60 and the fulcrum member 26 moved downwardly adjacent the working end to provide a fulcrum for pivoting or moving the tool about the fulcrum. The fulcrum member 26 may be appropriately positioned to provide the most efficient mechanical advantage and movement with respect to the operation of the tool.

Various alternative constructions are possible with the invention. For example, the shape of the rod 14 is indicated as being circular in cross section. However, other shapes may be utilized. The shape of the internal passage of the fulcrum member 26 is typically congruent with the cross sectional shape of the rod 14. In the embodiment shown, the handle 10 is a separate molded plastic material which is attached to the rod 14 by a pressing operation. However, the handle 10 may be formed as an extension of the rod 14. Thus, the invention is to be limited only by the following claims and equivalents.

What is claimed is:

1. A tool for removal of fasteners having an exposed head with a flange and a projecting stud from the head that effects attachment of the fastener to a substrate, said tool comprising, in combination:

a molded handle having a longitudinal axis;

a rod member projecting axially from the molded handle, said rod member including a handle end for attachment of the molded handle and a distal working end for engagement under a flange of a headed fastener to pry the fastener from a substrate, said rod member further including an axial segment having a substantially uniform cross section, said axial segment including at least one projecting prong at the molded handle end; and a fulcrum member including an axial throughpassage and axial slots in the passage to permit axial sliding movement of the fulcrum member onto the axial segment of the rod member from the molded handle end, said fulcrum member extending radially from the axial segment to provide an axially adjustable fulcrum support for the tool upon placement of the working end on a fastener head.

2. The tool of claim 1 wherein the axial segment has a circular cross section and the fulcrum member is an annular member with a circular, cross section central axial passage, said passage having a diameter substantially equal to the diameter of the axial segment.

3. The tool of claim 1 or 2 wherein the fulcrum member is an elastomeric material.

4. The tool of claim 1 wherein the working end comprises a bifurcated foot having spaced prongs for fitting under a fastener flange and around the stud of the flange.

5. The tool of claim 1 or 2 wherein the fulcrum member is slidable between a first position adjacent the working end and a second position adjacent the handle.

6. The tool of claim 1 or 2 wherein the working end has a cross sectional dimension greater than the cross section dimension of said passage in the fulcrum member to frictionally retain the fulcrum member on the axial segment intermediate the working end and the handle.

7. The tool of claim 1 or 2 wherein the working end comprises a wedge member.

8. The tool of claim 1 or 2 wherein the working end includes a section of the rod forms an angle with the axial direction of the rod axial segment.

9. The tool of claim 1 or 2 wherein the fulcrum member is comprised of a urethane material.

10. The tool of claim 1 or 2 wherein the axial segment includes a plurality of projecting prongs slidable in the fulcrum member slot.

* * * * *